United States Patent [19]

Funakubo

[11] 4,018,390

[45] Apr. 19, 1977

[54] SLEEVE FOR USE IN A MEAT CHOPPER

[76] Inventor: Shinnosuke Funakubo, 3-6-1, Gyotoku Ekimae, Ichikawa, Chiba, Japan

[22] Filed: Jan. 22, 1976

[21] Appl. No.: 651,352

[52] U.S. Cl. ..... 241/82.5

[51] Int. Cl.[2] ..... B02C 18/36

[58] Field of Search ..... 241/82.1, 82.2, 82.3, 241/82.4, 82.5, 82.6, 82.7

[56] References Cited

UNITED STATES PATENTS

| | | | |
|---|---|---|---|
| 2,624,384 | 1/1953 | Ward | 241/82.5 |
| 3,286,551 | 11/1966 | Tipton | 241/82.5 |
| 3,730,444 | 5/1973 | Pattillo | 241/82.5 |

*Primary Examiner*—Granville Y. Custer, Jr.
*Attorney, Agent, or Firm*—Shlesinger, Fitzsimmons & Shlesinger

[57] ABSTRACT

A sleeve for protecting the wear of a driven stud shaft in a meat chopper. Said sleeve is releasably fittable to the stud shaft and movable integrally with said shaft for completely eliminating sliding wear therebetween.

3 Claims, 3 Drawing Figures

SLEEVE FOR USE IN A MEAT CHOPPER

This invention relates to an improvement of a meat chopper, and more particularly, it relates to an improved sleeve means for a stud shaft which drives a rotary knife in the meat chopper.

As known, in the meat chopper either manually driven or power driven, its rotary knife which chops, in cooperation with a grinder plate, the meat forcibly pressed towards said grinder plate by a screw auger, is driven by a stud shaft which is threadedly fixed to the screw auger and rotates therewith. Such stud shaft usually has three integral and coaxial sections, viz., an inner section threadedly fitted into the screw auger, a middle section having an outer configuration which closely fits with the inner wall of a central opening provided in the rotary knife so that the driving force of the screw auger can be transmitted to the knife, and a journal section which is rotatably supported by a central opening in the hub of the grinder plate. It shall be readily apparent that wear of the stud shaft occurs mainly at the aforementioned journal section because the shaft frictionally engages the central opening in hub of the grinder plate. When the wear of the stud shaft at said section becomes comparatively large, the shaft as a whole has to be replaced by a new piece in order to assure the effective cooperation between the knife and the grinder plate and also in order to assure proper alignment of the screw auger with the associated chopper housing. But, such replacement of the shaft is not as easy as one might consider, since the threaded engagement of the stud shaft with the screw auger becomes tighter as the chopper repeats its operations, and in addition, since chops or fatty substances which adhere to the threaded portions between the stud shaft and the auger, and are decomposed by oxidation, make the aforementioned threaded engagement even more difficult to break.

In order to avoid such difficult replacement of the stud shaft as a whole, it has been proposed by those skilled in the art to provide a sleeve around the journal section of the stud shaft. This seems to have eliminated the wear of the stud shaft itself, while wear occurs only at the sleeve. However, the fact is that as such proposed sleeves are merely inserted over the journal section of the stud shaft, frictional or sliding wear occurs not only between the sleeve and the central opening in the hub of the grinder plate, but also between the sleeve and the stud shaft. On the other hand, if the sleeve is fixedly inserted upon the stud shaft in order to eliminate the sliding movement of the sleeve with respect to the journal of the stud shaft, it becomes impossible to remove the sleeve from the stud shaft when the former wears out.

In view of the above, it is an object of this invention to provide a novel sleeve in a meat chopper for use with a stud shaft which rotates integrally with a screw auger and which drives a knife integrally with said auger, said sleeve being easily and removably mounted over a journal of said stud shaft which is rotatably supported by a grinder plate, and the sleeve having means by which it can be removably secured to the stud shaft.

A preferred embodiment of this invention will be explained in detail hereinbelow by referring to the accompanying drawings, in which.

Figure 3:
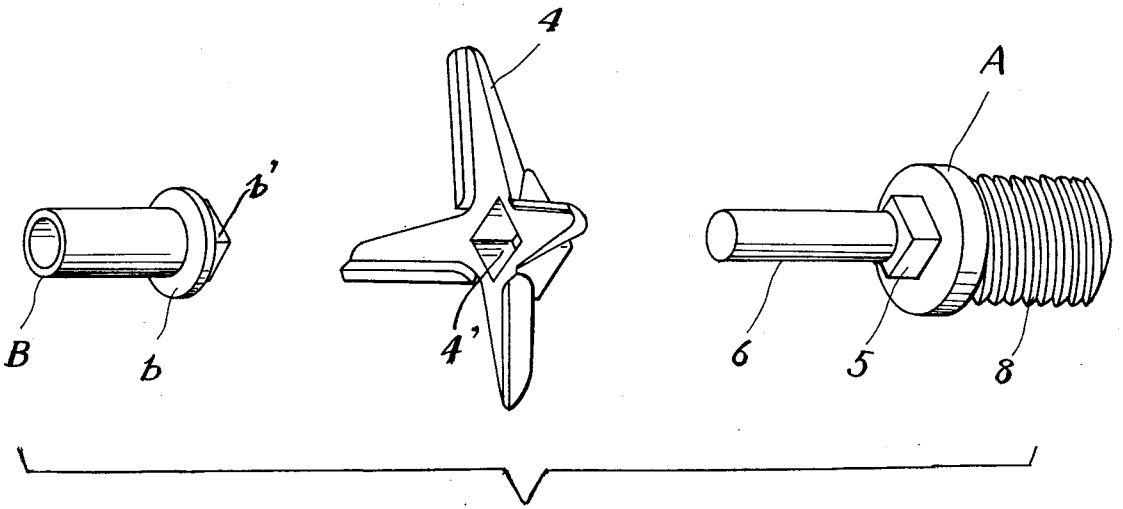
FIG. 3 is an exploded perspective view illustrating a sleeve, knife, and stud shaft made in accordance with the present invention, and which are adapted to rotate in unison when they are assembled together.

A screw auger 2 driven by a driving shaft 7 extends axially within a housing C. Meat introduced into the said housing C through an inlet 1 is forcibly driven by the rotating screw auger 2 towards the front opening of the housing C. A grinder plate 3 provided with a number of holes 3*b*, and also provided with a central opening or hub bore 3*a*, is positioned over the aforementioned front opening of housing C and fixed thereto by a retaining ring cap 10, which is in turn threadedly fixed at 9 to the housing. The meat continuously pressed by the auger 2 against the inner surface of the grinder plate 3 and subsequently forced into the holes 3*b*, is chopped by a rotary knife 4 which rotates with its radially extending blades or cutting edges facing the inner surface of plate 3. The knife 4 is assembled on and rotated by, a stud shaft A in the following manner. As best shown in FIG. 3, the stud shaft A has a threaded shank 8 at its inner or rear section, a square key portion or shoulder 5 at its middle section, and a cylindrical journal portion 6 at its front section. This shaft A has its shank 8 threadedly secured in the forward end of the auger 2 coaxially thereof so that the square key portion 5 and the journal portion 6 project axially from the front end of screw auger 2. The knife 4 has a rectangularly shaped central opening 4′, the configuration of which closely corresponds with the configuration of the square key portion 5 of the stud shaft A, and is fitted to the stud shaft A by having the key 5 inserted into the opening 4′ of the knife, whereby the knife rotates integrally with the auger 2 upon the latter's rotation. The depth of the central opening 4′ is made larger than the thickness or axial length of key 5, for the purpose explained hereinunder.

Figure 1:
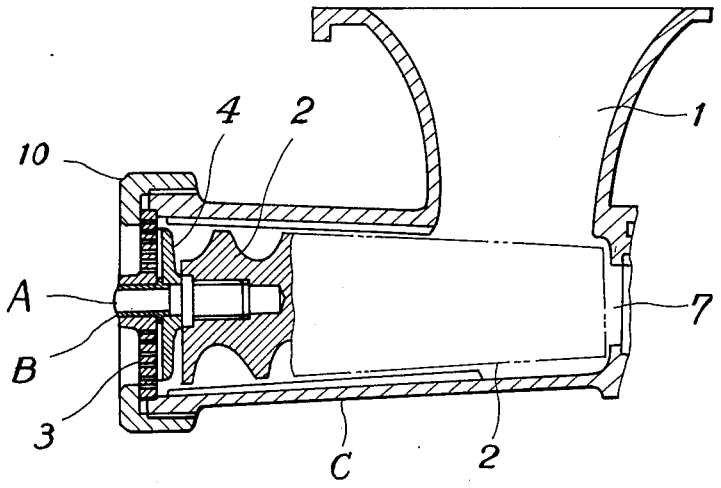
FIG. 1 is a sectional view of a meat chopper provided with the present invention.
Figure 2:
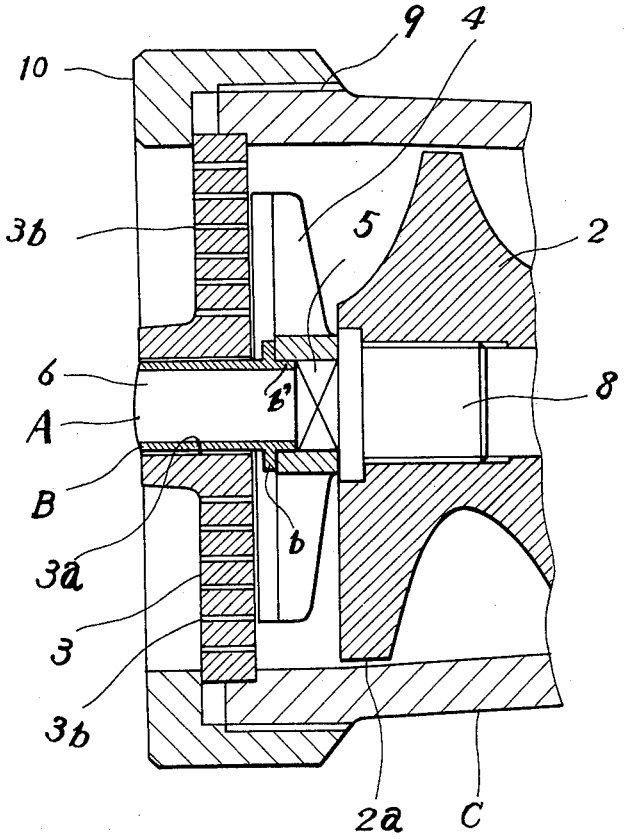
FIG. 2 is an enlarged, fragmentary sectional view of a part illustrated in FIG. 1.

A sleeve B which is made in accordance with the present invention, and is designed to protect the journal portion 6 of the stud shaft A from the wear which occurred in prior such choppers on account of the frictional engagement with the central opening in hub 3*a* of the grinder plate 3, has, as best shown in FIG. 2, an inner diameter substantially equal to the diameter of the journal 6 of the stud shaft, and an outer diameter less than the central opening 3*a* of the grinder plate 3. The sleeve has further a circumferential flange *b* which is located adjacent to the inner end of the sleeve. The inner end of the sleeve is shaped to have a square configuration defining a key portion *b*′, which is correspondent with the configuration of central opening 4′ of the knife, and which has an axial length of correspondent with the axial length of the said central opening 4′ less the height of the square key portion 5 of the stud shaft A. The sleeve B having the above construction is inserted over the journal 6 of the stud shaft, simultaneously with the insertion of the square key portion *b*′ into the central opening 4′ of the knife, whereby the sleeve B will then rotate with the stud shaft A. The grinder plate 3 is assembled thereafter into the housing, as described above. It shall be noted that the flange *b* of the sleeve B acts to prevent the sleeve from slipping out of its assembled position through the central opening in hub 3*a* of the grinder plate, and also prevents the meat during a chopping operation from entering into the central opening 4′ of the knife because the meat pressed by the auger towards the grinder plate acts between the said plate and the flange and urges the flange in the direction of the auger.

Disassembling of the parts of the chopper can readily be made in the orders just reverse to the aforementioned assembling orders, whereby the sleeve B can easily be replaced when it is worn out. And, the employment of the sleeve in accordance with the present invention can perfectly prevent the stud shaft from wearing, because as aforementioned, it does not directly engage with the central opening or hub 3*a* of the grinder plate, and because no frictional or sliding wear takes place between the sleeve and the stud shaft on account of the uniform rotary movement of the sleeve with the stud shaft.

What is claimed is:

1. In a meat chopper having a housing, an auger rotatable in a chamber in said housing to drive meat which is to be ground from an opening in one end of the chamber toward a perforated grinder plate which is secured over an opening in the opposite end of chamber, a stud shaft releasably secured at one end to said auger and having on its opposite end a cylindrical journal portion which projects coaxially and rotatably through a bore in said grinder plate, and a rotary knife releasably secured to said stud shaft intermediate the ends thereof for rotation thereby adjacent the inside surface of said grinder plate, the improvement comprising a bearing member having on one end a tubular portion surrounding said cylindrical portion of said shaft and projecting movably into one end of the bore in said grinder plate coaxially thereof, and means releasably connecting the opposite end of said bearing member to one end of said knife whereby the rotation of said knife is imparted to said bearing member, said tubular portion of said bearing member having an outside diameter less than the diameter of said bore in said grinder plate, whereby said tubular portion is disconnected from said grinder plate, and is rotatable in the bore thereof by said blade.

2. A meat chopper as defined in claim 1, wherein said connecting means comprises a rectangular projection on one of the confronting ends of said bearing member and said knife, respectively, releasably seated in a correspondingly shaped rectangular opening in the other of said confronting ends.

3. A meat chopper as defined in claim 2, wherein said rectangular projection is formed on said opposite end of said bearing member and projects slidably into a rectangular opening formed in said knife centrally thereof, whereby the rotation of said knife is imparted directly to said bearing member, and said bearing member has thereon a circumferential flange which projects between said grinder plate and said knife to prevent said rectangular projection from sliding axially out of said central opening in said knife during use, and to cover said central opening in the knife.

* * * * *